US009024189B2

(12) United States Patent
Basak et al.

(10) Patent No.: US 9,024,189 B2
(45) Date of Patent: May 5, 2015

(54) CABLE CONSTRUCTION

(75) Inventors: Debasmita Basak, Pearland, TX (US); Joseph Varkey, Sugar Land, TX (US); Ramaswamy Meyyappan, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 259 days.

(21) Appl. No.: 13/354,607

(22) Filed: Jan. 20, 2012

(65) Prior Publication Data

US 2012/0325514 A1 Dec. 27, 2012

Related U.S. Application Data

(60) Provisional application No. 61/501,015, filed on Jun. 24, 2011.

(51) Int. Cl.

| | |
|---|---|
| ***H01B 7/00*** | (2006.01) |
| ***H01B 13/14*** | (2006.01) |
| ***H01B 7/18*** | (2006.01) |
| *H01B 13/18* | (2006.01) |
| *H01B 7/04* | (2006.01) |

(52) U.S. Cl.

CPC ..... *H01B 13/144* (2013.01); *H01B 13/18* (2013.01); *H01B 7/046* (2013.01); *H01B 7/185* (2013.01)

(58) Field of Classification Search

USPC .... 174/68.1, 101 R, 105 R, 68.3, 70 R, 74 R, 174/75 R, 74 A, 84 R, 85, 88 R, 90, 94 R, 174/84 C, 84 SL, 70 C, 95, 96, 98, 99 R, 174/102 R, 107, 108, 110 R, 113 R, 114 R, 174/116, 113 C, 110 F; 166/385, 65.1, 378; 385/100, 101, 110, 114

See application file for complete search history.

(56) References Cited

U.S. PATENT DOCUMENTS

| | | | | |
|---|---|---|---|---|
| 3,748,369 | A * | 7/1973 | Durakis et al. | 174/36 |
| 3,764,725 | A * | 10/1973 | Kafka | 174/15.5 |
| 3,800,066 | A | 3/1974 | Whitfill, Jr. et al. | |
| 4,721,355 | A | 1/1988 | Gould | |
| 5,044,722 | A | 9/1991 | Voser | |
| 5,191,173 | A * | 3/1993 | Sizer et al. | 174/105 R |
| 5,920,672 | A | 7/1999 | White | |
| 6,392,151 | B1 | 5/2002 | Rafie et al. | |
| 6,533,039 | B2 | 3/2003 | Rivas et al. | |
| 6,534,986 | B2 | 3/2003 | Nichols | |
| 6,888,097 | B2 | 5/2005 | Batarseh | |
| 7,325,596 | B2 | 2/2008 | Ebner | |
| 7,413,021 | B2 | 8/2008 | Madhavan et al. | |
| 7,420,120 | B2 | 9/2008 | Vertente et al. | |
| 7,458,421 | B2 | 12/2008 | Barrow et al. | |

(Continued)

FOREIGN PATENT DOCUMENTS

| | | |
|---|---|---|
| GB | 1441149 | 6/1976 |

*Primary Examiner* — Angel R Estrada
*Assistant Examiner* — Dimary Lopez Cruz

(57) ABSTRACT

A technique facilitates installation of cables in a variety of environments, including downhole environments. A cable is provided with a core surrounded by a protective jacket. In the radial space between the core and the protective jacket, a filler mechanism is deployed in the axial direction along the cable. The filler mechanism is designed to provide easy access to the core to facilitate coupling with various related components while limiting risk involved with exposing the core.

8 Claims, 6 Drawing Sheets

(56) References Cited

U.S. PATENT DOCUMENTS

| | | | | |
|---|---|---|---|---|
| 7,465,876 | B2 | 12/2008 | Varkey | |
| 7,520,321 | B2 | 4/2009 | Hiron et al. | |
| 7,670,451 | B2 * | 3/2010 | Head | 156/293 |
| 7,903,915 | B2 | 3/2011 | Meyyappan et al. | |
| 2002/0172477 | A1 | 11/2002 | Quinn et al. | |
| 2004/0016539 | A1 | 1/2004 | Richard | |
| 2005/0006117 | A1 | 1/2005 | Bertini et al. | |
| 2006/0213665 | A1 | 9/2006 | Ebner | |
| 2006/0225926 | A1 | 10/2006 | Madhavan et al. | |
| 2007/0131418 | A1 | 6/2007 | Barrow et al. | |
| 2008/0223585 | A1 | 9/2008 | Patel et al. | |
| 2008/0264630 | A1 | 10/2008 | Lavrut et al. | |
| 2009/0065200 | A1 | 3/2009 | Howard et al. | |

* cited by examiner

CABLE CONSTRUCTION

CROSS-REFERENCE TO RELATED APPLICATION

The present document is based on and claims priority to U.S. Provisional Application Ser. No. 61/501,015, filed Jun. 24, 2011, incorporated herein by reference.

BACKGROUND

Hydrocarbon fluids such as oil and natural gas are obtained from a subterranean geologic formation, referred to as reservoir, by drilling a well that penetrates the hydrocarbon-bearing formation. Once a wellbore is drilled, various forms of well completion components may be installed to control and enhance the efficiency of producing various fluids from the reservoir. The various well completion components may utilize cabling to connect components with each other and/or with the well surface to enable passage of power or data signals. Because downhole environments often have high pressure and high temperature conditions, cabling placed downhole is designed with protective elements to provide a certain degree of protection in the harsh downhole environment. However, such elements can add a degree of difficulty with respect to cabling installation procedures.

SUMMARY

In general, the present disclosure provides a system and method which facilitate installation of cables in a variety of environments, including downhole environments. A cable is provided with a core surrounded by a protective jacket. In the radial space between the core and the protective jacket, a filler mechanism is deployed in the axial direction along the cable. The filler mechanism is designed to provide easy access to the core to facilitate coupling with various related components while limiting risk involved with exposing the core.

BRIEF DESCRIPTION OF THE DRAWINGS

Certain embodiments will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

Figure 1:
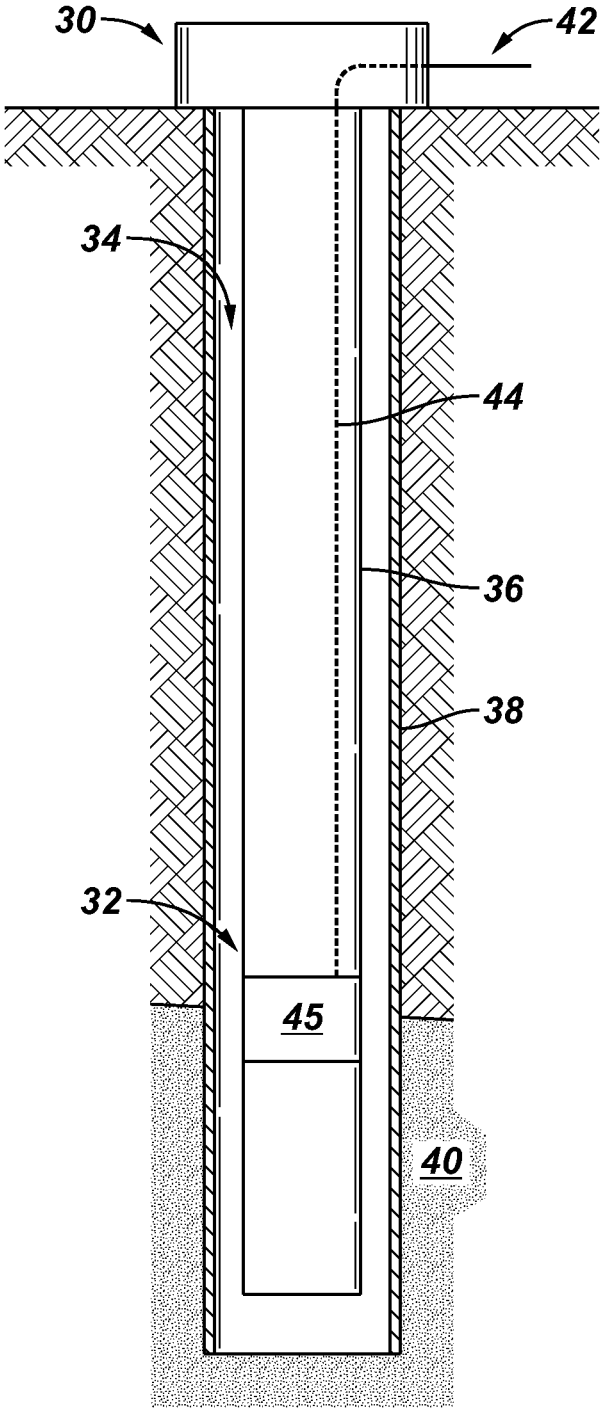
FIG. 1 is a schematic illustration of an example of a downhole system utilizing a cable, according to an embodiment of the disclosure.
Figure 2:
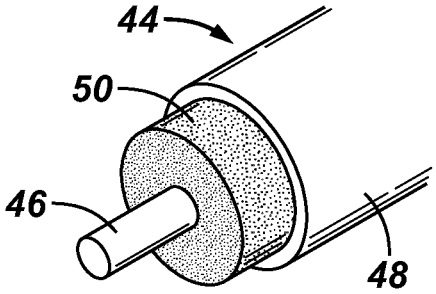
FIG. 2 is a schematic illustration of an example of a cable having a filler mechanism that facilitates coupling of the cable with other components, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally involves a system and methodology related to cable systems. The technique is designed to provide a cable which is easily coupled to many types of components. In an example, the cabling is designed to facilitate coupling into well completion systems for the transmission of power and/or data signals between components of well systems. However, the cabling system and methodology for making and/or using the cable may be applied to a variety of other applications, including non-well applications.

In some embodiments, the cabling may be designed with an outer protection layer or jacket, an inner core, and a filler mechanism radially positioned between the jacket and the core. In an instrumentation cable, for example, the core may be protected from the environment and from damage during handling by a jacket formed of a harder and more robust material than the core. The filler mechanism may be used to center the core or otherwise to hold the core at a desired position within the jacket for providing a secondary layer of protection. For example, the filler mechanism may be constructed with materials that provide stability for the core during vibration and shock.

To enable coupling of the cable to another component in certain applications, the core is exposed to facilitate connection. In some prior systems, filler material was removed by some type of mechanical cutting operation or by heating the cable at a desired separation point to soften the filler material for removal. However such techniques sometimes proved to be time-consuming, inefficient, contrary to site-specific regulation, damage causing, and/or difficult due to specialty equipment requirements.

In some embodiments of the present disclosure, the cable system is designed with a filler mechanism that does not require removal of filler material to enable coupling. In this example, the cable is designed with a filler mechanism having intermittent filler sections which enables termination, e.g. coupling, of the cable to another component without removing filler material. In another embodiment, the filler mechanism comprises wound filler material, such as a spirally wound tape filler material. The wound filler material may simply be unwound to expose the core in a fast and simple manner without requiring special equipment.

Cabling systems may be designed with a variety of cables for use in many types of well applications and non-well applications. The cables may be constructed with various numbers of layers comprising the protective jacket(s), filler and core. The core may be made of single or multiple communication lines, e.g. conductors, optical fibers, or combinations of communication lines, which are encased by the filler mechanism and the jacket.

Referring generally to FIG. 1, an example of one type of cabling application is illustrated as utilizing a cable extending down into a wellbore and coupled with individual or multiple downhole components, e.g. a downhole completion component. The example is provided to facilitate explanation, and it should be understood that cabling as described herein may be used in conjunction with many well or non-well related systems. Also, the illustrated cable may be located in a variety of downhole and surface environments and may be constructed in various configurations depending on the operational and environmental characteristics of a given application.

In FIG. 1, an embodiment of a well system 30 is illustrated as comprising a well completion 32 deployed in a wellbore 34. The completion 32 may be part of a tubing string or tubular structure 36 and may include a variety of components, depending in part on the specific application, geological characteristics, and well type. In the example illustrated, wellbore 34 is substantially vertical and lined with a casing 38. However, various types of well completions 32 may be used in a well system having other types of wellbores, including deviated, e.g. horizontal, single bore, multilateral, cased, and uncased (open bore) wellbores. In the example illustrated, wellbore 34 extends down into a subterranean formation 40 having at least one production zone from which hydrocarbon-based fluids are produced.

The well system 30 further comprises a cabling system 42 having a cable 44. The cable 44 extends downhole from a surface location and is coupled with an appropriate component or components 45 of well completion 32. In this example, cable 44 may carry power signals, data signals, or a combination of power and data signals. By way of example, the cable 44 may comprise an instrumentation cable designed to carry power and/or data signals between instruments and other components located downhole and/or at a surface location. However, the illustrated well system 30 is provided only as an example and the cabling system 42 may be utilized in many types of downhole applications, surface applications, combination applications, and other non-well related applications.

Figure 3:
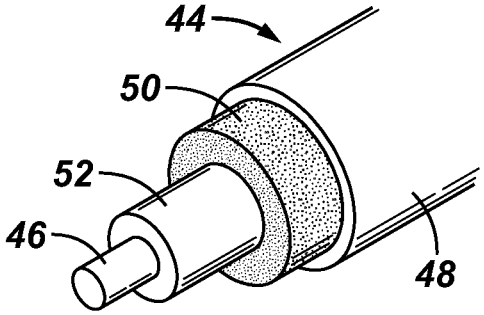
FIG. 3 is a schematic illustration of another example of a cable, according to an embodiment of the disclosure.

Referring generally to FIGS. 2-5, examples of cable 44 are illustrated. In the embodiment illustrated in FIG. 2, cable 44 comprises a core 46, a jacket 48, and a filler mechanism 50 disposed radially between core 46 and jacket 48. In some applications, filler mechanism 50 is designed to radially center the core 46 within the surrounding jacket 48. Depending on the specific application, a layer of insulation 52 may be disposed between core 46 and filler mechanism 50, as illustrated in FIG. 3. In this particular application, the core 46 and insulation layer 52 are combined to form an insulated core. Core 46 may be designed to carry various signals, such as electrical signals and/or optical signals.

Figure 4:
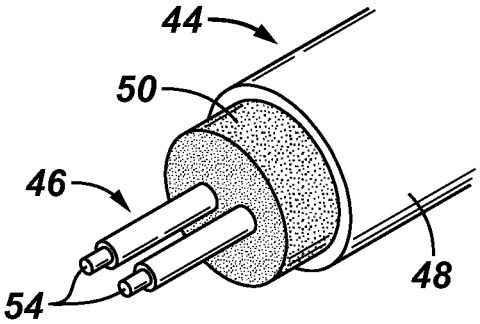
FIG. 4 is a schematic illustration of another example of a cable, according to an embodiment of the disclosure.
Figure 5:
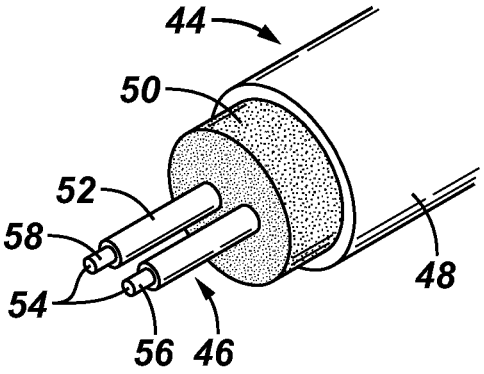
FIG. 5 is a schematic illustration of another example of a cable, according to an embodiment of the disclosure.

The core 46 also may comprise various numbers and types of signal carriers. As illustrated in FIG. 4, for example, core 46 comprises a plurality of carriers 54 in the form of electrical conductors. However, the signal carriers 54 may comprise other types of signal carriers or combinations of signal carriers, such as the combined optical fiber signal carrier 56 and electrical conductor signal carrier 58 illustrated in FIG. 5.

Figure 6:
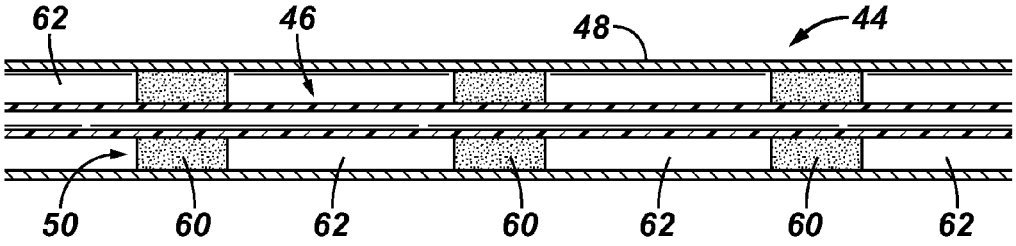
FIG. 6 is a schematic illustration of a cable utilizing an embodiment of the filler mechanism, according to an embodiment of the disclosure.
Figure 7:
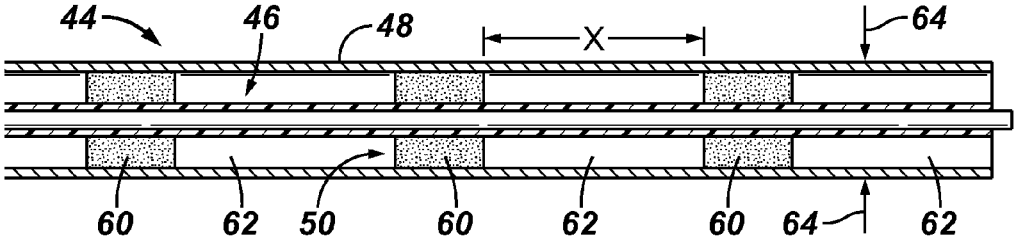
FIG. 7 is a schematic illustration similar to that of FIG. 6 but showing a designated area for exposing a core to facilitate coupling to another component, according to an embodiment of the disclosure.
Figure 8:
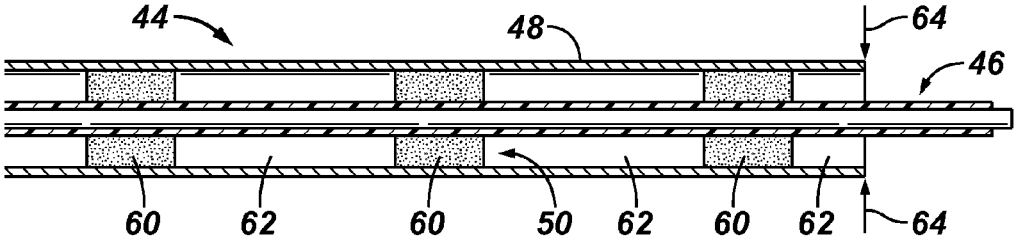
FIG. 8 is a schematic illustration similar to that of FIG. 7 but showing a portion of the jacket removed, according to an embodiment of the disclosure.

Referring generally to FIGS. 6-8, an embodiment of cable 44 is illustrated in which the filler mechanism 50 is formed as a plurality of individual filler sections 60. In this embodiment, the individual filler sections are arranged so that sequential filler sections 60 are separated in an axial direction by gaps 62 along at least a portion of the length of cable 44, as illustrated in FIG. 6. In some applications, the sequential filler sections 60 separated axially by gaps 62 extend along the entire length of the cable 44. The plurality of filler sections 60 surround the core 46 and support the core 46 within the jacket 48 at a desired, spaced radial distance from the jacket 48. The filler mechanism 50 and the intermittent filler sections 60 are designed to securely hold the core 46 inside the jacket 48 and to give the core 46 stability against shock and vibration. The intermittent filler mechanism 50 can be manufactured according to several methods, as described in greater detail below. The filler sections 60 may be formed of a variety of materials. For example, filler material used to form filler mechanism 50 can be metallic, non-metallic, polymeric, elastomeric, or of another suitable material or combination of materials. The filler mechanism 50 can be constructed in a variety of forms from the metallic, non-metallic, polymeric, elastomeric, or other suitable material positioned between core 46 and jacket 48 in a variety of structures to fill the void completely or partially between core 46 and jacket 48.

The intermittent filler mechanism 50 eradicates the need to remove filler material during coupling, e.g. termination, of the cable 44. The design also provides a very strong bonding between the jacket 48 and the core 46 which lowers the risk of the core 46 retracting inside the jacket 48 during operation. The design also enables construction of a cable capable of use in high-temperature and high-pressure environments while reducing the amount of equipment otherwise needed to form the termination/coupling. Substantial time savings are achieved during cable installation procedures compared to conventional designs.

By providing the gaps 62 with a predetermined axial length x, as illustrated in FIG. 7, and by knowing the axial lengths of filler sections 60, a technician is able to easily determine a desired location along the cable for exposing the core 46 without interfering with the filler material of filler mechanism 50. This knowledge enables the technician to pinpoint exactly where to cut and remove the jacket 48, as represented by arrows 64. Knowing the gap length x allows the technician to expose the precise axial length of core 46 desired for a given installation procedure, e.g. termination, as illustrated in FIG. 8. The actual length x can vary depending on the application and the desired available core length between sections 60 of filler material. In some applications, for example, the length x may be selected as between 1 and 2 cm while other applications may employ longer lengths x, e.g. 2 or more centimeters, or shorter lengths, e.g. 1 cm or less but greater than zero.

In some applications, it may be desirable to provide access to the space between the cable core 46 and the jacket 48 and the technician can easily remove the appropriate portion of jacket 48 and, if necessary, the adjacent filler section 60. For example, the technician can calculate exactly where to cut the cable 44 and can remove the adjacent short filler section 60 to provide an increased length of exposed core 46 within the jacket 48. For various applications, the optimum gap length x and the length of the filler sections 60 can be calculated and/or simulated by an appropriate modeling technique or other suitable technique. Access to the space between the jacket 48 and the core 46 is desirable in many different operations including cable sealing applications utilizing cable sealing assemblies that use core protection placed inside the cable jacket 48 and around the core 46.

The filler designs described herein help minimize space required between the instrumentation core 46 and the inside diameter of the jacket, e.g. armor, 48. This enhances the instrumentation capability of cable 44 by enabling placement of more instrumentation lines and/or improvement of instrumentation performance through, for example, larger gauge electrical wires. The larger numbers of instrumentation lines and/or the larger gauge instrumentation lines are enabled through the ability to have a larger instrumentation core 46. The larger instrumentation core 46, in turn, is possible because of the reduced space required between the instrumentation core 46 and the inside diameter of jacket 48. These capabilities can be very useful when drilling deeper wells into higher pressure environments and/or as more instrumentation is added to downhole completions to better understand the completions and to enhance reservoir recovery.

Figure 9:
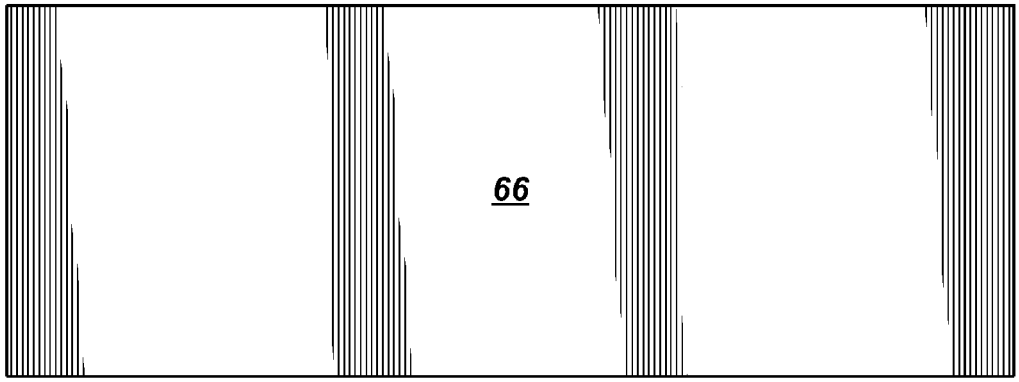
FIG. 9 is a schematic illustration of a flat section of jacket material which may be used in a manufacturing process during construction of the cable, according to an embodiment of the disclosure.
Figure 10:
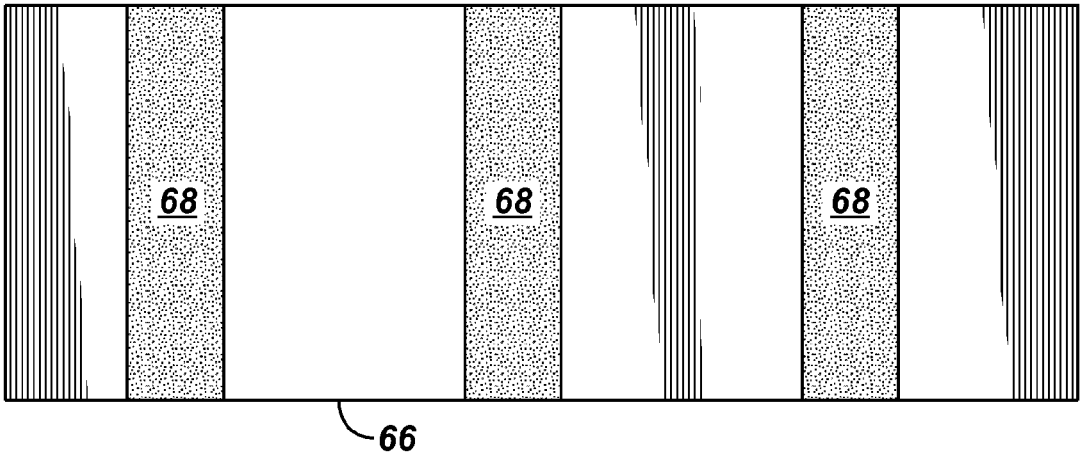
FIG. 10 is a schematic illustration similar to that of FIG. 9 but showing the addition of sections of filler material along the jacket to create sequential, axial gaps between the sections of filler material, according to an embodiment of the disclosure.

A variety of methods may be used to manufacture an intermittent cable 44 of the type illustrated in FIGS. 6-8. An example of a manufacturing method is described with reference to FIGS. 9-12 and this method may utilize a variety of cores built before assembly of the cable 44. In this embodiment, a length of jacket strip 66 is laid flat in the manufacturing run, as illustrated in FIG. 9. By way of example, the flat strip 66 may be a metal strip, although other suitable materials may be used to form jacket 48, including composite materials and plastic materials. Along the jacket strip 66, deposits of filler material 68, e.g. filler paste, having predefined dimensions are stamped or otherwise disposed at predefined intervals, as illustrated in FIG. 10. The deposits of filler material 68 are then solidified by cooling or another suitable technique. In some applications, adhesives may be mixed with the filler material 68 to provide improved adherence to the jacket 48 and/or the core 46.

Figure 11:
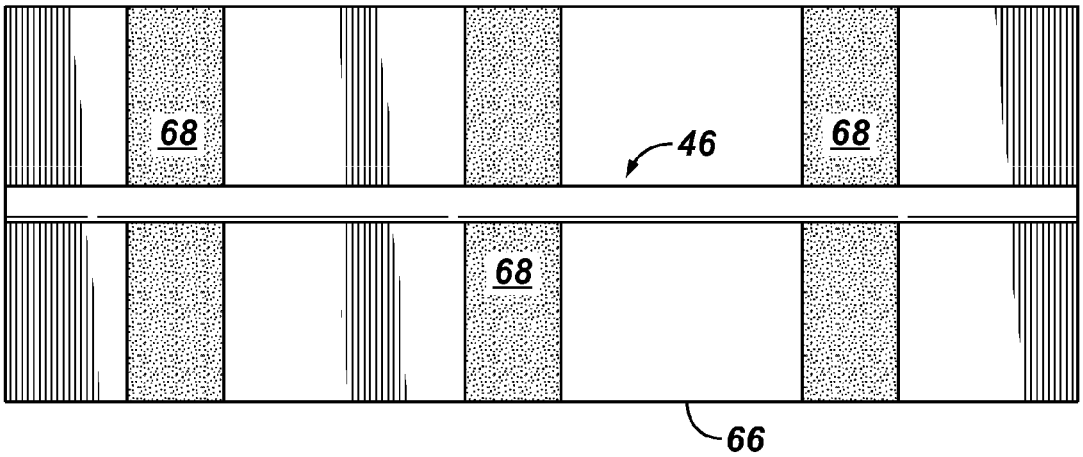
FIG. 11 is a schematic illustration similar to that of FIG. 10 but showing a core positioned along the jacket and filler mechanism, according to an embodiment of the disclosure.
Figure 12:
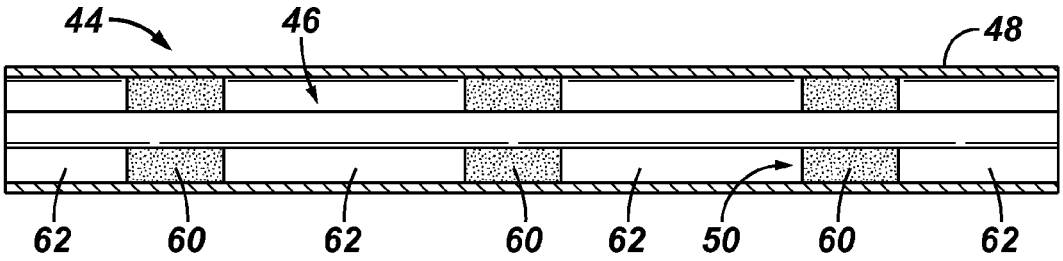
FIG. 12 is a schematic illustration similar to that of FIG. 11 in which the jacket has been rolled into tubular form around the core, according to an embodiment of the disclosure.

The core 46 may then be laid along the deposits of filler material 68, as illustrated in FIG. 11. Subsequently, the strip 66 and the applied deposits of filler material 68 are rolled around the core 46 to form cable 44, as illustrated in FIG. 12. By way of example, the strip 66 and the deposits of filler material 68 may be rolled around the core 46 and the resulting longitudinal seam along the jacket 48 may be welded or otherwise sealed. In some applications, the process of forming cable 44 comprises sequentially rolling, welding, and drawing the jacket 48. Additionally, the deposits of filler material 68 forming filler mechanism 50 may be heat treated to achieve a better compression force, if desired, after drawing the cable.

Figure 13:
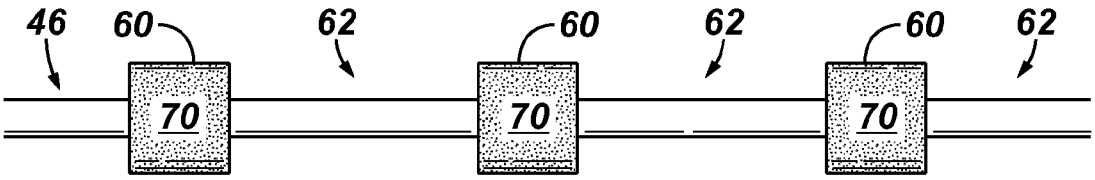
FIG. 13 is a schematic illustration showing the attachment of axially separated filler sections to a core, according to an embodiment of the disclosure.
Figure 14:
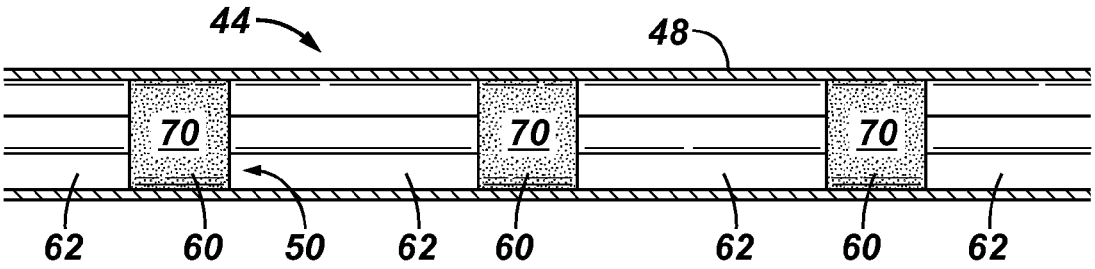
FIG. 14 is a schematic illustration similar to that of FIG. 13 but with the jacket positioned around the core and the sections of filler material, according to an embodiment of the disclosure.
Figure 16:
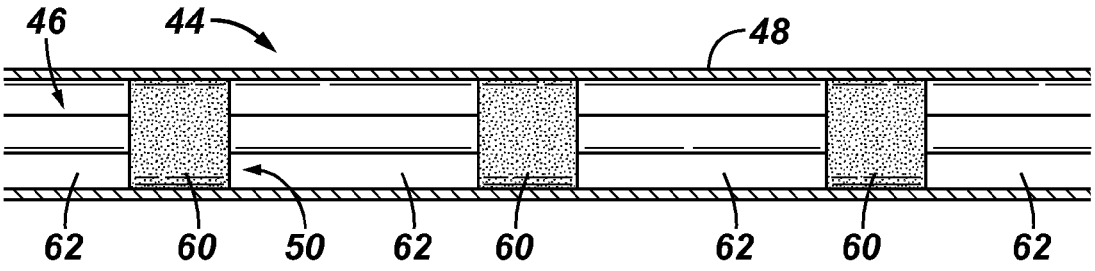
FIG. 16 is a schematic illustration similar to that of FIG. 15 but with the jacket positioned around the core and the sections of filler material, according to an embodiment of the disclosure.

Referring generally to FIGS. 13-14, another example of a manufacturing method for forming the intermittent cable 44 with intermittent filler mechanism 50 is illustrated. In this example, multiple filler sections 60 are formed of heat shrink material 70 and are placed around core 46 at axially sequential positions separated by gaps 62. By way of example, the heat shrink material 70 may be in the form of single piece or multiple piece shrink material tubes which are slid over or assembled around the core 46, as illustrated in FIG. 13. The heat shrink material 70 is then shrunk by applying heat (or by another suitable technique) to cause the heat shrink material 70 to securely grip core 46. The jacket 48 may then be applied around the filler sections 60 of the filler mechanism 50, as illustrated in FIG. 16. If the jacket 48 is metal, the jacket may be applied by a rolling, welding, and drawing technique as described above.

Figure 15:
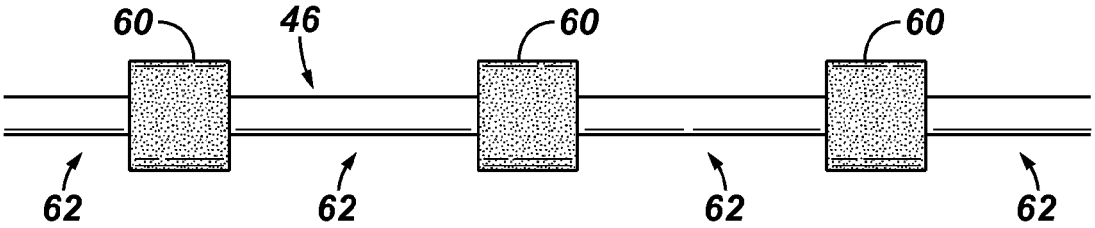
FIG. 15 is a schematic illustration showing separated filler sections which have been positioned along a core by a selective extrusion process, according to an embodiment of the disclosure.

Referring generally to FIGS. 15-16, another method of forming cable 44 is illustrated. In this example, the filler mechanism 50 is formed as an intermittent filler mechanism by a selective extrusion process using an adjustable extrusion head. The adjustable extrusion head is controlled so that the extrusion head diameter changes periodically to produce a selected filler mechanism outside diameter profile, as illustrated in FIG. 15. The jacket 48 may then be rolled or otherwise applied over the plurality of sequential filler sections 60, as illustrated in FIG. 16. As described above, the jacket 48 may be applied by a rolling, welding, and drawing technique or by another suitable technique. For example, if the jacket 48 is formed from a non-metal material other types of assembly techniques may be employed, including molding, bonding and adhering techniques for this embodiment and other embodiments described herein. In some applications, the methodology illustrated in FIGS. 15-16 may comprise scraping away excess filler material between the filler sections 60 right after the filler extrusion process. As the core 46 moves out of the extrusion head during the filler mechanism extrusion process, the filler material is hot and in a semi-liquid state. While in this state, the core 46 can be passed through a circular, adjustable scraper to scrape off the filler material intermittently to produce the intermittent filler mechanism 50 illustrated in FIG. 15.

Figure 17:
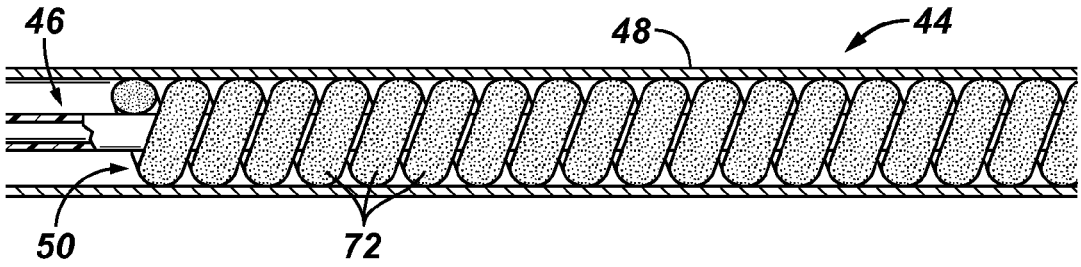
FIG. 17 is a schematic illustration of an example of the cable having a wrapped filler material, according to an embodiment of the disclosure.

In some embodiments, the cable 44 is constructed with filler mechanism 50 in the form of a spirally wrapped filler 72, as illustrated in FIG. 17. In this type of embodiment, the filler mechanism 50 also is designed to hold the core 46 inside the jacket 48 and to provide the core 46 with stability against shock and vibration. By way of example, the spirally wrapped filler 72 may comprise a filler tape that is spirally wrapped around the core 46. During a coupling/termination procedure, an end of the spirally wrapped filler 72 may be gripped and pulled out of the jacket 48 to expose the core 46. The desired number of wraps of the spirally wrapped filler 72 may simply be pulled from the end of the cable 44 and then severed to create a void of desired length between the core 46 and the jacket 48. During manufacture, jacket 48 may be positioned over the filler mechanism 50 according to methods described above or according to other suitable methods.

Figure 18:
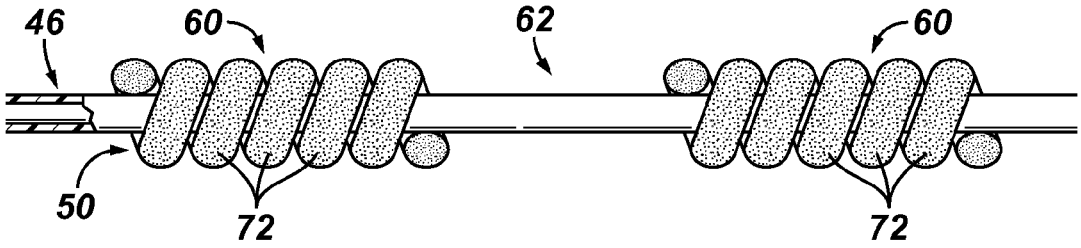
FIG. 18 is a schematic illustration of an example of the cable with axially separated sections of wrapped filler material, according to an embodiment of the disclosure.
Figure 19:
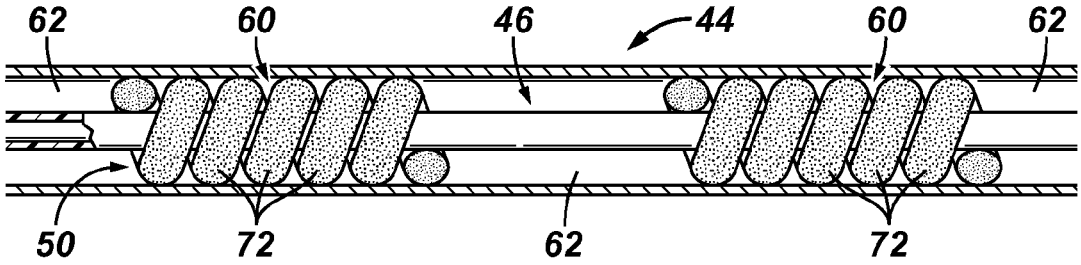
FIG. 19 is a schematic illustration similar to that of FIG. 18 but with the jacket positioned around the core and the filler material, according to an embodiment of the disclosure.

As illustrated in FIGS. 18-19, the spirally wrapped filler 72 also may be split into sequential filler sections 60 to create another style of intermittent filler mechanism 50. In this example, the filler material, e.g. filler tape 72, is spirally wrapped around core 46 intermittently to create gaps 62, as illustrated in FIG. 18. As with previously described embodiments, jacket 48 may be positioned around the spirally wrapped filler sections 60, as illustrated in FIG. 19, according to various suitable methods. Depending on the specific application, the spirally wrapped filler 72 can be fused, coated, and/or heat treated to provide a desired compression force.

Depending on the application, cable 44 may be constructed in many lengths and diameters. The cable 44 also may be used in a variety of environments and applications, and the characteristics of a given environment and/or application may affect the selection of materials for use in constructing the core, filler mechanism, and/or jacket. In some applications, additional layers, e.g. insulation layers, may be combined in the cable construction. Additionally, numerous coupling/termination techniques may be used for joining the cable with other components, such as other sections of cable, instruments, tools, and other components. The design of the cable facilitates use of the cable in a variety of well related and non-well related applications. Depending on the application, several techniques may be employed for removing sections of jacket to expose the core of the cable.

Although only a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system, comprising:

a cable having:

a core;

a jacket disposed around the core; and a plurality of discrete filler sections axially separated by a plurality of gaps along the core, the plurality of discrete filler sections supporting the core within the jacket at a radial position separated from the jacket, wherein the gaps are axially longer than the discrete filler sections.

2. The system as recited in claim 1, wherein the core comprises a conductor.

3. The system as recited in claim 1, wherein the core comprises a plurality of signal carriers.

4. The system as recited in claim 1, wherein the jacket comprises a metal material.

5. The system as recited in claim 1, wherein the plurality of filler sections comprises filler paste.

6. The system as recited in claim 1, wherein the plurality of filler sections comprises heat shrink material.

7. The system as recited in claim 1, wherein the plurality of filler sections comprises filler tape wrapped around the core.

8. A system, comprising:

a cable having:

a core;

a jacket disposed around the core; and a plurality of discrete fillers positioned radially between the core and the jacket, the individual fillers being spirally wrapped around the core and separated axially by gaps, and wherein the gaps are axially longer than the discrete fillers.

* * * * *